US012680727B2

(12) United States Patent
Gagne et al.

(10) Patent No.: US 12,680,727 B2
(45) Date of Patent: Jul. 14, 2026

(54) FLUID HEATING SYSTEM WITH COMBUSTION TRIM LEARNING

(71) Applicant: A. O. Smith Corporation, Milwaukee, WI (US)

(72) Inventors: Curtis George Gagne, Smyrna, TN (US); Yonggon Lee, Brookfield, WI (US); Brian Thomas Branecky, Oconomowoc, WI (US); Barry Anthony Collins, Lebanon, TN (US); Daniel Mitchell, Gallatin, TN (US); Mohamed Mehdi Doura, Mt. Juliet, TN (US)

(73) Assignee: A. O. Smith Corporation, Milwaukee, WI (US)

( * ) Notice: Subject to any disclaimer, the term of this patent is extended or adjusted under 35 U.S.C. 154(b) by 264 days.

(21) Appl. No.: 18/530,557

(22) Filed: Dec. 6, 2023

(65) Prior Publication Data

US 2024/0110728 A1 Apr. 4, 2024

Related U.S. Application Data

(63) Continuation of application No. 17/733,756, filed on Apr. 29, 2022, now Pat. No. 11,885,531.

(Continued)

(51) Int. Cl.
*F24H 9/20* (2022.01)
*F23N 5/00* (2006.01)

(Continued)

(52) U.S. Cl.
CPC ..... *F24H 9/2035* (2013.01); *F23N 5/006* (2013.01); *F24H 1/0027* (2013.01); *F24H 15/31* (2022.01);

(Continued)

(58) Field of Classification Search
CPC ..... F24H 9/2035; F24H 1/0027; F24H 15/31; F24H 15/33; F24H 15/35; F24H 15/36;

(Continued)

(56) References Cited

U.S. PATENT DOCUMENTS 4,586,893 A 5/1986 Somerville et al.
5,363,091 A 11/1994 Kotwicki et al.

(Continued)

FOREIGN PATENT DOCUMENTS

WO 2009105094 A1 8/2009
WO 2010062287 A1 6/2010

OTHER PUBLICATIONS

Aerco. AERtrim System for Benchmark Boilers Technical Data Sheet. 2018. Available online at <https://www.aerco.com/dfsmedia/0533dbba17714b1ab581ab07a4cbb521/57687-source/aertrim-tds> (2 pages).

(Continued)

*Primary Examiner* — Michael G Hoang
*Assistant Examiner* — Kurt J Wolford
(74) *Attorney, Agent, or Firm* — Michael Best & Friedrich LLP

(57) ABSTRACT

A fluid heating system including a burner unit is operated based on feedback control loops. The fluid heating system comprises a burner unit configured to heat a fluid, a sensor configured to sense a characteristic of the appliance, and a controller coupled to the burner unit and the sensor. The controller includes an electronic processor and a memory. The controller is configured to receive a first signal corresponding to the characteristic from the sensor, determine, based on the first signal, a first feedback loop control, control combustion of the burner unit based on the first feedback loop control, determine, based on the first feedback loop control, a second feedback loop control, and control com- (Continued)

bustion of the burner unit based on the second feedback loop control.

27 Claims, 12 Drawing Sheets

Related U.S. Application Data

(60) Provisional application No. 63/182,352, filed on Apr. 30, 2021.

(51) Int. Cl.

| | |
|---|---|
| ***F24H 1/00*** | (2022.01) |
| ***F24H 15/31*** | (2022.01) |
| ***F24H 15/33*** | (2022.01) |
| ***F24H 15/35*** | (2022.01) |
| ***F24H 15/36*** | (2022.01) |
| ***F24H 15/414*** | (2022.01) |

(52) U.S. Cl.
CPC ..... *F24H 15/33* (2022.01); *F24H 15/35* (2022.01); *F24H 15/36* (2022.01); *F24H 15/414* (2022.01); *F23N 2223/36* (2020.01); *F23N 2241/04* (2020.01)

(58) Field of Classification Search
CPC .... F24H 15/414; F23N 5/006; F23N 2223/36; F23N 2241/04
See application file for complete search history.

(56) References Cited

U.S. PATENT DOCUMENTS

| | | | | |
|---|---|---|---|---|
| 6,453,665 | B1 | 9/2002 | Bower, Jr. et al. | |
| 8,439,667 | B2 * | 5/2013 | Fan | F23N 1/082 700/289 |
| 8,602,772 | B2 | 12/2013 | Fan et al. | |
| 10,094,321 | B1 | 10/2018 | Anschuetz et al. | |
| 10,422,531 | B2 | 9/2019 | Super et al. | |
| 10,935,431 | B2 | 3/2021 | Kramer | |
| 2019/0203936 | A1 * | 7/2019 | Hazzard | G05B 19/0426 |

OTHER PUBLICATIONS

Aerco Benchmark Platinum Boilers with Edge [ii] Controller Operation and Service Manual. Section 9: Aertrim Operation. Jan. 6, 2021. Available online at <https://www.aerco.com/dfsmedia/0533dbba17714b1ab581ab07a4cbb521/74040-source/benchmark-platinum-750-6000-operation-and-service-manual-omm-0137-gf-211>. pp. 116-129.

European Patent Office Extended European Search Report for application 22170957.9, dated Oct. 7, 2022, 11 pages.

Canadian Patent Office Action for Application No. 3156927 dated Nov. 4, 2025 (3 pages).

* cited by examiner

800

FLUID HEATING SYSTEM WITH COMBUSTION TRIM LEARNING

CROSS-REFERENCE TO RELATED APPLICATIONS

This application is a continuation of U.S. patent application Ser. No. 17/733,756 filed Apr. 29, 2022, which claims the benefit of U.S. Provisional Application No. 63/182,352 filed Apr. 30, 2021. The entire disclosures of the above applications are incorporated by reference.

FIELD

Embodiments relate generally to fluid heating systems having combustion feedback controls to control combustion. More specifically, embodiments relate to controlling the combustion of a combination boiler through multiple feedback loops.

SUMMARY

Controlling combustion of boilers, water heaters, and furnaces can be challenging given that a number of variables may need to be controlled during combustion. In the case of some modulating boilers, combustion is non-continuously controlled. Non-continuously controlled combustion is tuned periodically while the boiler is operating at a specific firing rate. Alternatively, combustion may be continuously regulated, ignoring the modulation percentage/firing rate. Some current methods of combustion control do not account for certain factors, such as venting draft and venting restriction, that do not affect combustion uniformly with respect to modulation percentage/firing rate. Because such continuous combustion control methods do not account for these factors, the specific modulation percentage/firing rate effects are not accounted for. Therefore, sub-optimal combustion exists while operating at the specific modulation percentages/firing rates because the combustion control fails to correct control based on the certain factors.

It is desirable to control combustion using feedback control loops that adapt based on various factors. These control loops may control an independent variable such as an air fuel ratio (for example, by using $O_2$ concentration). Alternatively, or additionally, the control loops could control other independent or dependent variables such as a NOx concentration, a CO concentration, a combustion oscillation/noise, a flame characteristic, and/or a burner temperature. The feedback control loops may control the variable at various operating conditions. The various operating conditions may be influenced by factors such as modulation percentage/firing rate, fuel quality (for example, a Wobbe index, a higher heating value, and/or a density), a fuel supply pressure, a manifold gas pressure, a barometric pressure, outdoor temperature, a combustion air temperature, a flame rectification/flame signal, a flame flicker/flame signal frequency, a fan speed, an airflow, an actual gas flow, a flame temperature, a flame appearance/characteristics (such as a flame length, a flame light spectrum/composition presence, a flame light wavelength, a flame color and/or distribution on burner, a flame stability, and/or a flame light intensity), a humidity, a combustion condensate flow, a flue temperature, burner temperature(s), and/or a dry-to-wet concentration ratios of various combustion products (such as $O_2$, NOx, and/or $CO_2$).

In order to optimally and efficiently adapt the feedback control loops, trim values may be learned. This may be accomplished by implementing "learned" feedback control loops. Learned feedback control loops allow the feedback control loop to correct control based on certain factors at specific firing rates. Using learned feedback loops helps to ensure proper control of combustion in the case that a sensor fails, and/or a fault condition occurs. For example, $O_2$ sensors typically have a finite life and may be prone to faults and failures. Accordingly, by using a learned feedback control loop, over time a system can continue to benefit from the use of an $O_2$ sensor even once the sensor is no longer in use.

One embodiment disclosed herein provides a fluid heating system. The fluid heating system includes a burner unit configured to heat a fluid, a sensor configured to sense a characteristic of the appliance, and a controller coupled to the burner unit and the sensor. The controller includes an electronic processor and a memory. The controller is configured to receive a first signal corresponding to the characteristic from the sensor, determine, based on the first signal, a first feedback loop control, control combustion of the burner unit based on the first feedback loop control, determine, based on the first feedback loop control, a second feedback loop control, and control combustion of the burner unit based on the second feedback loop control.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (for example, stored on non-transitory computer-readable medium, executable by one or more processing units, such as a microprocessor and/or application specific integrated circuits ("ASICs")). As such, it should be noted that a plurality of hardware and software-based devices, as well as a plurality of different structural components, may be utilized to implement the embodiments. For example, "servers," "computing devices," "controllers," "processors," etc., described in the specification can include one or more processing units, one or more computer-readable medium modules, one or more input/output interfaces, and various connections (for example, a system bus) connecting the components.

Relative terminology, such as, for example, "about," "approximately," "substantially," etc., used in connection with a quantity or condition would be understood by those of ordinary skill to be inclusive of the stated value and has the meaning dictated by the context, for example, the term includes at least the degree of error associated with the measurement accuracy, tolerances (for example, manufacturing, assembly, use, etc. associated with the particular value. Such terminology should also be considered as disclosing the range defined by the absolute values of the two endpoints. For example, the expression "from about 2 to about 4" also discloses the range "from 2 to 4". The relative terminology may refer to plus or minus a percentage (for example, 1%, 5%, 10%) or more, of an indicated value.

It should be understood that although certain drawings illustrate hardware and software located within particular devices, these depictions are for illustrative purposes only.

Functionality described herein as being performed by one component may be performed by multiple components in a distributed manner. Likewise, functionality performed by multiple components may be consolidated and performed by a single component. In some embodiments, the illustrated components may be combined or divided into separate software, firmware and/or hardware. For example, instead of being located within and performed by a single electronic processor, logic and processing may be distributed among multiple electronic processors. Regardless of how they are combined or divided, hardware and software components may be located on the same computing device or may be distributed among different computing devices connected by one or more networks or other suitable communication links. Similarly, a component described as performing particular functionality may also perform additional functionality not described herein. For example, a device or structure that is "configured" in a certain way is configured in at least that way but may also be configured in ways that are not explicitly listed.

Other aspects of the embodiments will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways.

Figure 1:
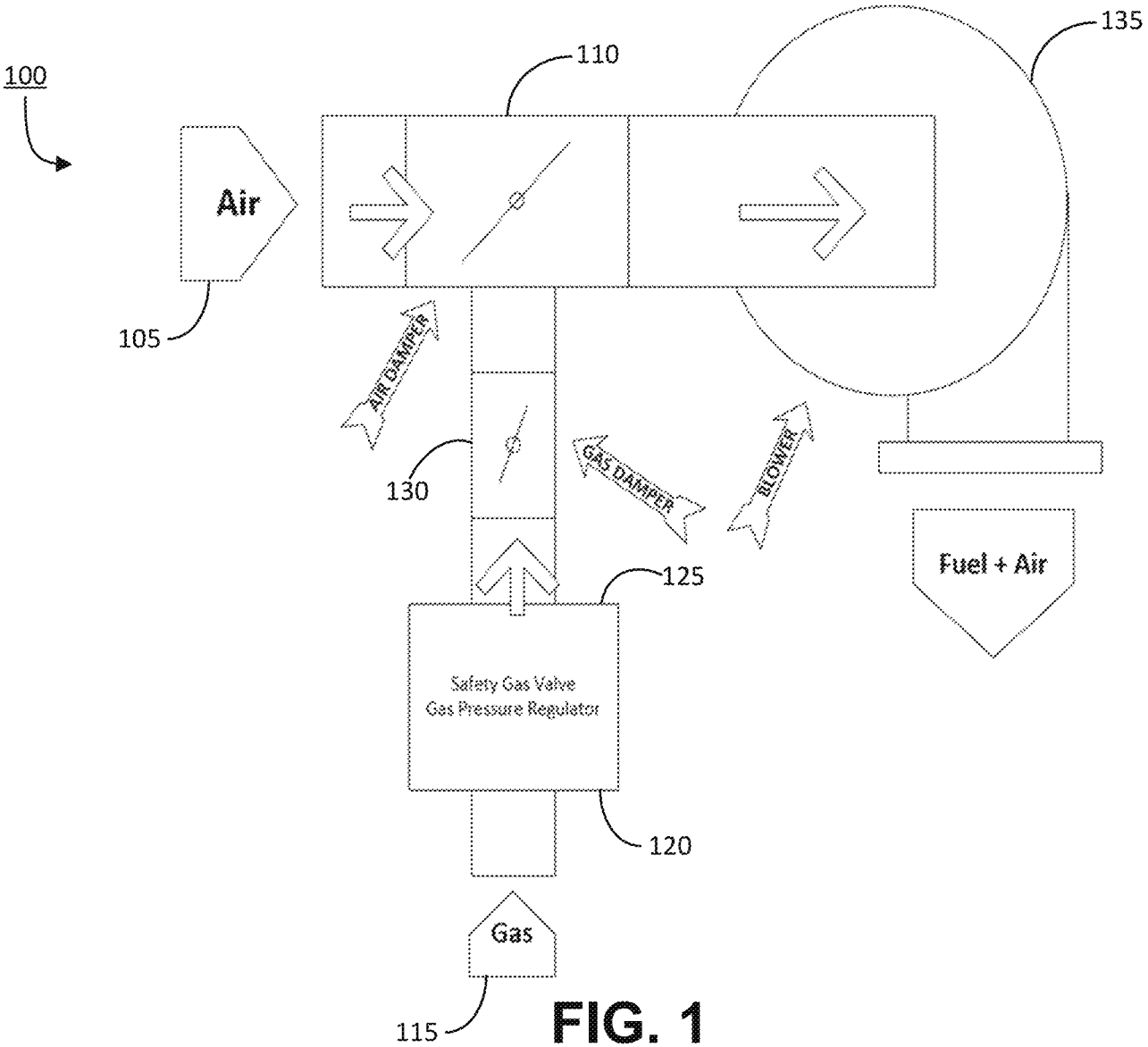
FIG. 1 is a block diagram of a combustion system according to some embodiments.

FIG. 1 illustrates a combustion system 100 for heating a fluid in a fluid heating system according to some embodiments. In some embodiments, the fluid heating system is a boiler, (for example, a modulating boiler or a non-modulating boiler). In such an embodiment, the combustion system 100 is configured to heat a fluid (for example, water). In other embodiments, the fluid heating system is a water heater or a furnace. In such an embodiment, the combustion system 100 is configured to heat a fluid (for example, water) contained within a tank.

The combustion system 100 is used to provide a premixed fuel and air mixture to a burner (not shown). In some embodiments, the burner may be a multi-stage burner. The combustion system 100 includes a source of air 105, an air damper 110, a source of gas 115, a safety gas valve 120, a gas pressure regulator 125, a gas damper 130, and a variable speed blower 135. The air damper 110 controls the amount of air that is mixed with a gas (for example, natural gas or propane), so that a desirable air to fuel ratio can be maintained. The safety gas valve includes a lever to open and close the flow of gas from a gas source. The gas pressure regulator includes an adjustment screw and spring that allows for varying the gas pressure. The gas damper 130 controls the flow of gas that is mixed with air prior to being fed to the variable speed blower, thereby varying the heat output of the burner. The variable speed blower can be controlled to run at different speeds to control the flow of the air and gas mixture to the burner.

Figure 2:
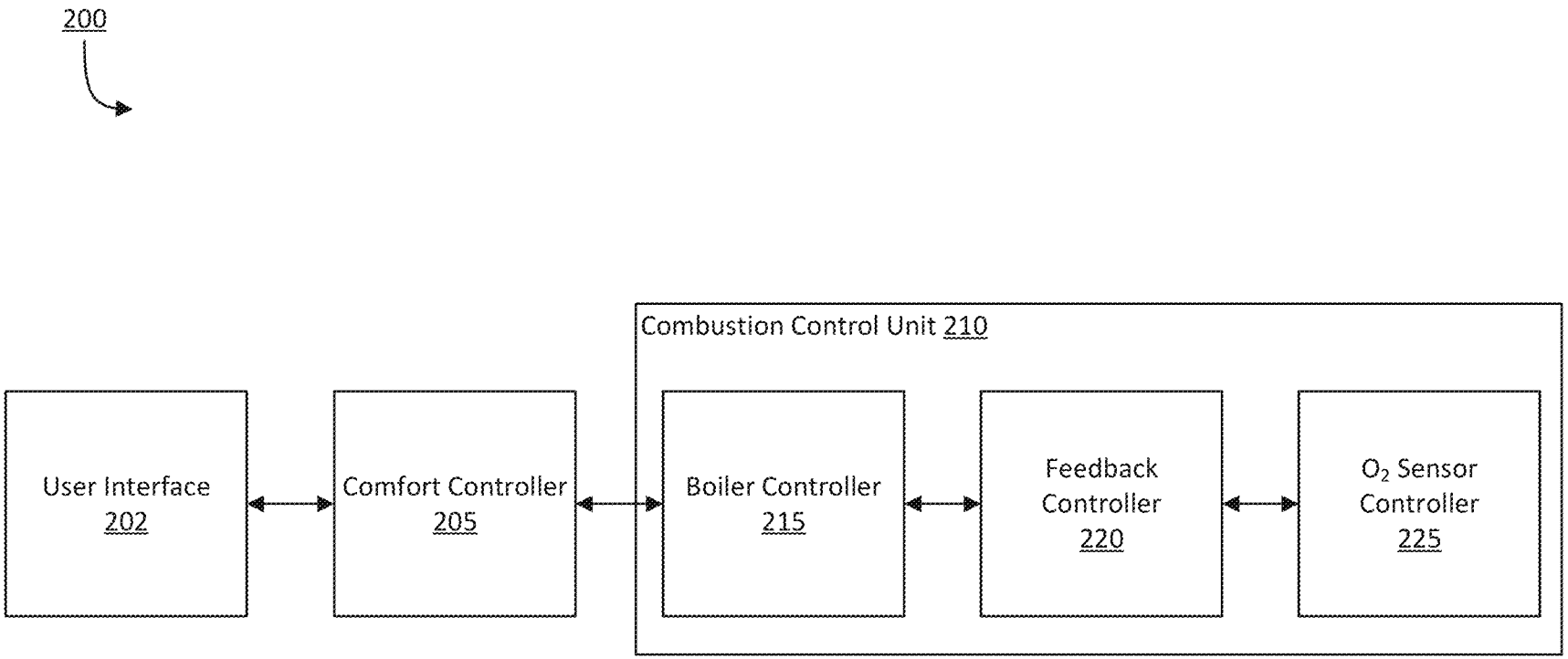
FIG. 2 is a block diagram of a combustion system control of the combustion system of FIG. 1 according to some embodiments.

FIG. 2 is a block diagram of a combustion system control 200 according to some embodiments. In the illustrated embodiment, the combustion system control 200 includes a user interface 202, a comfort controller 205, and a combustion control unit 210 that includes a boiler controller 215, a feedback controller 220, and an $O_2$ sensor controller 225.

Each controller in the combustion system control 200 includes a combination of hardware and software components. Although illustrated as separate controllers, in other embodiments the controllers of the combustion system control 200 may be a single unit, or grouped together in multiple controller groupings. Each controller may include a printed circuit board ("PCB") that is populated with a plurality of electrical and electronic components that provide power, operational control, and/or protection to the fluid heating system. The PCB may include an electronic processor (for example, a microprocessor, a microcontroller, or another suitable programmable device or combination of programmable devices), a memory, and a bus, such as a controller-area network bus ("CAN bus"). The bus connects various components of the PCB, such as the memory to the electronic processor. The memory includes, for example, a read-only memory ("ROM"), a random access memory ("RAM"), an electrically erasable programmable read-only memory ("EEPROM"), a flash memory, a hard disk, or another suitable magnetic, optical, physical, or electronic memory device. The electronic processor may be connected to the memory and executes software instructions that are capable of being stored in the RAM (for example, during execution), the ROM (for example, on a permanent basis), or another non-transitory computer readable medium such as another memory or disc.

Additionally, or alternatively, the memory is included in the electronic processor. Software included in the implementation of the fluid heating system is stored in the memory of the respective controller that it pertains to. The software includes, for example, firmware, one or more applications, program data, one or more program modules, and other executable instructions. The controllers are configured to retrieve from memory and execute, among other things, instructions related to the control processes and methods described herein.

Each controller may also include an input/output ("I/O") system that includes routines for transferring information between components within the controller and/or other components of the water heating system. The I/O system may include a wireless receiver/transmitter for wireless communicating with other controllers and/or an external device. In some embodiments, each controller receives power from a power supply (for example, an input power 305). The input power 305 may be, for example, a mains power supply, a battery source, for example, AA batteries, AAA batteries, etc., solar panels, thermo-electric generators (TEG), or a wall power adapter.

The PCB of each controller also includes, among other things, a plurality of additional passive and active components such as resistors, capacitors, inductors, integrated circuits, converters, and amplifiers. These components are arranged and connected to provide a plurality of electrical functions to the PCB including, among other things, filtering, signal conditioning, signal converter, and voltage regulation.

Each component of the combustion system control 200 will now be described with respect to their specific function. The user interface 202 may be connected to a housing of the fluid heating system and is used to modify settings of the fluid heating system (for example, by a user). In some embodiments, the user interface 202 may include a variety of buttons, a touchscreen, LEDs, or some combination thereof. A user or operator of the fluid heating system may change the operational status of the fluid heating system by selecting the desired operational status on the user interface 202.

The comfort controller 205 receives inputs from the user interface 202 and communicates them to the combustion control unit 210 to control combustion of the fluid heating system. These inputs may include non-safety switch inputs (such as thermostat/aquastat inputs), non-safety demand management sensor inputs (such as outdoor/tank/system temperatures), Building Management System (BMS) data, Building Automation System (BAS) data, options to cascade multiple heaters in unison, and boiler control operating data (such as clearing operation states and errors). The comfort controller 205 may also output one or more signals with respect to heat demands, field outputs (such as alarms), louvers, run-time, pump requirements (ON/OFF or speed), mixing valve values, BMS and BAS output data, and signals corresponding to the cascading of multiple heaters, to the combustion control unit 210. The comfort controller 205 may also provide data back to the user interface 202. For example, the comfort controller 205 may provide the user interface 202 with the combustion system status, error handling instructions, and/or information from the feedback controller 220.

Figure 3:
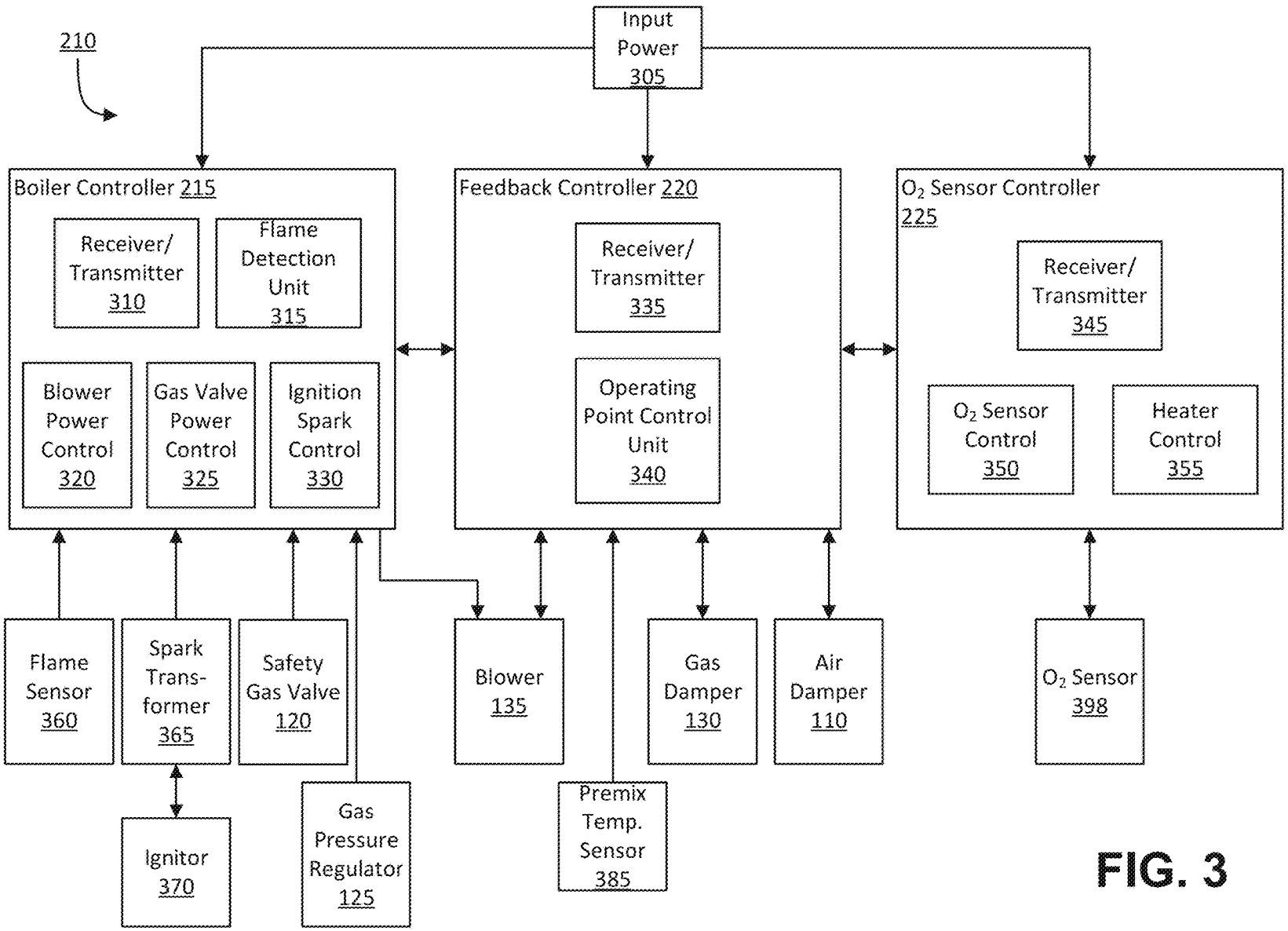
FIG. 3 is a block diagram of a combustion control unit of the combustion system of FIG. 1 according to some embodiments.

FIG. 3 is a block diagram of the combustion control unit 210 according to some embodiments. In the illustrated embodiment, the combustion control unit 210 includes the boiler controller 215, the feedback controller 220, and the $O_2$ sensor controller 225. The boiler controller 215, the feedback controller 220, and the $O_2$ sensor controller 225 receive power from the input power 305, as discussed above.

In general operation, the boiler controller 215 controls components of combustion at desired operating conditions and provides data to the comfort controller 205 to provide to the user interface 202 (for example, combustion system status, error handling instructions, and information from the feedback controller 220). In the illustrated embodiment, the boiler controller 215 includes a receiver/transmitter 310, a flame detection unit 315, a blower power control 320, a gas valve power control 325, and an ignition spark control 330. The boiler controller 215 receives inputs from the comfort controller 205, a flame sensor 360, the safety gas valve 120, and the gas pressure regulator 125. The input from the comfort controller 205 may include operating demand information. The flame detection unit 315 receives a flame detection input from the flame sensor 360. The safety gas valve 120 and the gas pressure regulator 125 provide safety switch inputs to the boiler controller 215 such as a pressure switch that can detect blockages and air flow and a flow switch that can determine if there is adequate water to be heated by the combustion system 100. As discussed in more detail below, the boiler controller 215 may also receive input from the feedback controller 220, as well as output the operating demand received from the comfort controller 205 to the feedback controller 220.

The ignition spark control 330 determines whether current is supplied to the spark transformer 365 to ignite the ignitor 370. The blower power control 320 outputs a determined amount of blower power (for example, via a pulse-width modulated (PWM) signal) to the blower 135. The blower power control 320 can also perform blower control signal override where it removes a load (for example, 24 Vdc) from the blower, thus causing the blower to run at the maximum speed. The gas valve power control 325 provides a determined amount of power to the gas valve 120 to control the gas valve.

In general operation, the feedback controller 220 is configured to control components of combustion based on feedback signals from multiple combustion components. In the illustrated embodiment, the feedback controller 220 includes a receiver/transmitter 335 and an operating point control unit 340. The operating point control unit 340 receives a barometric pressure input, a pre-mix air temperature input from the premix temperature sensor 385, an operating demand input from the boiler controller 215, and/or $O_2$ sensor data from the $O_2$ sensor controller 225. The $O_2$ sensor data may include probe temperature, $O_2$ concentration, operating state, and/or error information. The operating point control unit 340 controls the positions of the gas damper 130 and the air damper 110 and the speed of the blower 135. In some embodiments, the output includes increasing or decreasing the blower 135 speed, adjusting the gas damper 130 angle, and/or adjusting the air damper 110 angle. In addition, the feedback controller 220 provides output to the $O_2$ sensor controller 225 such as operating state, calibration, and/or error handling. In response to receiving feedback from the blower 135, the premix temperature sensor 385, the gas damper 130, the air damper 110, and the $O_2$ sensor controller 225, the feedback controller 220 provides data to the boiler controller 215 to communicate to the user interface 202. For example, the data may include the barometric pressure, the $O_2$ concentration, the operating status, and error handling instructions.

In general operation, the $O_2$ sensor controller 225 controls components of the $O_2$ sensor including heater control, $O_2$ sensor error handling, and $O_2$ sensor validity status. In the illustrated embodiment, the $O_2$ sensor controller 225 includes a receiver/transmitter 345, an $O_2$ sensor control 350, and a heater control 355. The $O_2$ sensor controller 225 receives inputs from the feedback controller 220 that may include operating state requirements dependent upon the operating state the fluid heating system is being run in, such as a free air calibration trigger, a zero calibration trigger, and/or an error reset trigger. The heater control 355 receives an $O_2$ sensor heater status (ON/OFF) depending on the operating state. The $O_2$ sensor controller 225 further receives a 12 Vdc load from the feedback controller 220 and an $O_2$ sensor reading and a sensing element resistance relating to element temperature from the $O_2$ sensor 398.

The $O_2$ sensor controller 225 outputs both a corrected and uncorrected $O_2$ concentration value based on the $O_2$ sensor 398 input, a sensing element resistance based on the $O_2$ sensor 398 input, and a sensor status. The $O_2$ sensor controller 225 also outputs error information relating to the $O_2$ sensor 398 (for example, information relating to an $O_2$ sensor error), the $O_2$ sensor heater, a communication error, and a calibration error. The $O_2$ sensor error may include an $O_2$ sensor open/short fault, an over temperature limit of the $O_2$ sensor fault, a high temperature of the $O_2$ sensor warning, a low temperature limit of the $O_2$ sensor fault, and/or a low temperature of the $O_2$ sensor warning. The $O_2$ sensor heater error may include a heater open/short fault and/or a timeout of heater temperature rising fault. The communication error includes, for example, a communication timeout fault. The calibration error includes, for example, a gain over warning, an out of correction allowable range warning, an out of gain variation range warning, and/or a zero-point calibration warning.

Figure 4:
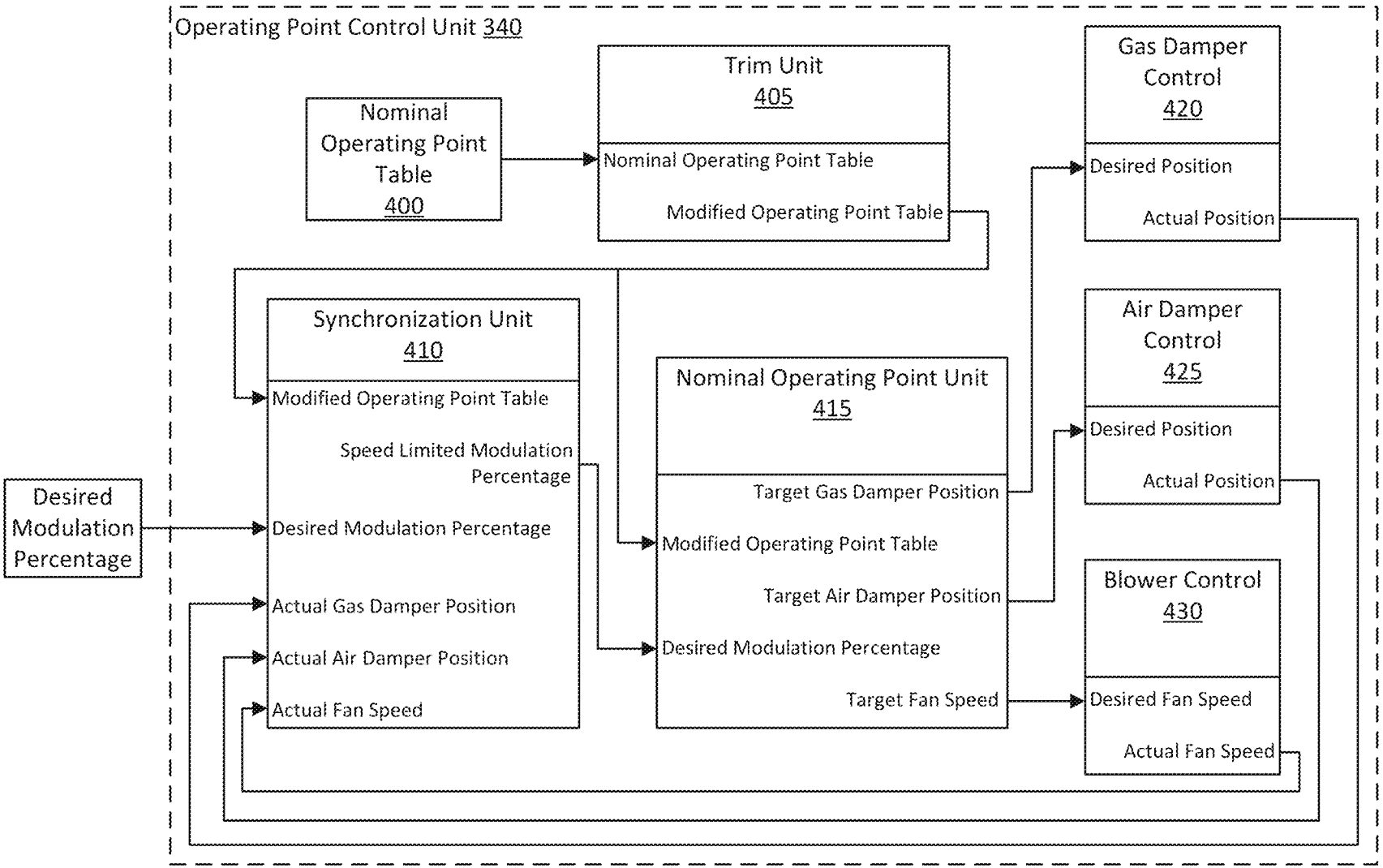
FIG. 4 is a block diagram of an operating point control unit of the combustion system of FIG. 1 according to some embodiments.

FIG. 4 is a block diagram of the operating point control unit 340 according to some embodiments. In general operation, the operating point control unit 340 is configured to synchronize modifications to nominal combustion control based on various inputs. In the illustrated embodiment, the operating point control unit 340 includes a nominal operating point table 400, a trim unit 405, a synchronization unit 410, a nominal operating point unit 415, a gas damper control 420, an air damper control 425, and a blower control 430. The nominal operating point table 400 may contain nominal operating points that are defined during the development and production of the fluid heating system. Nominal operating points may include, but are not limited to, the gas damper position (as an angle), air damper position (as an angle), and/or fan speed that correspond to a given operating condition of the fluid heating system. Specific operating points can be predefined for conditions such as an ignition operating point, a purge operating point, a standby operating point, and/or a failsafe operating point. In some embodiments, the nominal operating point table 400 defines various operating points related to modulation percentage/firing rate. For example, the nominal operating point table 400 may include ten points corresponding to ten modulation percentages/firing rates. In order to determine operating points that fall between the ten (for example) modulation percentages/firing rates, linear interpolation is performed, as discussed in detail below.

The nominal operating point table 400 outputs a nominal operating point to the trim unit 405. The trim unit 405 performs operating point modification on the nominal operating points to control and/or adjust combustion characteristics using trim values, as discussed in detail below. The trim unit 405 outputs a modified operating point table, which is input into the synchronization unit 410.

The synchronization unit 410 ensures that the modified operating points correspond to operating points on an operating curve when implemented into the combustion system. In addition to the modified operating point table, the synchronization unit 410 receives inputs including a desired modulation percentage, an actual gas damper position, an actual air damper position, and/or an actual fan speed. The desired modulation percentage may be provided by the boiler controller 215. The synchronization unit 410 outputs a speed limited modulation percentage. The speed limited modulation percentage may be different than the desired modulation percentage, unless the fluid heating system is operating in a steady-state or slow modulating condition. The speed limited modulation percentage may be limited by how fast it can change. For example, this limit may be expressed in the percent change per second (%/sec). The limit is based on the speed limits of the gas damper, air damper, and/or blower. In order to change the modulation percentage according to the speed limited modulation percentage, the target gas damper position, air damper position, and/or fan speed is progressively changed in small increments approaching the desired modulation percentage.

The actual gas damper position, the actual air damper position, and the actual fan speed make up a synchronization feedback loop. The synchronization feedback loop is utilized to ensure that the gas damper, air damper, and blower are within a respective tolerance range based on the speed limited modulation percentage. For example, the tolerance ranges may be calculated between points in the nominal operating table using linear interpolation and/or a step function. If one or more components are not within their respective tolerance ranges, the speed limited modulation percentage will be paused from changing to ensure that each component maintains within tolerance during operation. When the speed limited modulation percentage is paused, a modulate back function takes place. In some embodiments, the speed limited modulation percentage is paused for a pre-determined time to ensure the components are back within tolerance. For example, a synchronization wait time is entered. The synchronization wait time may be in the range of approximately 0-600 seconds.

During the modulate back function, a modulate back time is entered in which the speed limited modulation percentage begins to slowly move in the opposite direction from the desired modulation percentage until all of the components are back within their respective tolerance ranges. For example, the modulate back time may be in the range of approximately 0-120 seconds. A modulate back speed controls how fast the synchronization unit 410 will change the modulation rate while modulating back. For example, the modulation back speed may be approximately 0.1%/sec. Once one or more components are within their respective tolerances, the speed limited modulation percentage will be held at a value for a modulate forward time until either the desired modulation percentage crosses over the value or the burner of the fluid heating system shuts off. For example, the modulate forward time may be in the range of approximately 0-120 minutes. Using a modulate back functions allows operation up to a maximum fan speed to be accomplished and allows limited operation in case of issues such as a damper being stuck.

When a fluid heating system transitions from an ignition state to a run state, the synchronization unit 410 operates using the speed limited modulation percentage to ensure components stay within their respective tolerances.

The speed limited modulation percentage is output from the synchronization unit 410 to a desired modulation percentage input of the nominal operating point unit 415. Additionally, the modified operating point table may be received from the trim unit 405 (for example, via the modified operating point table input of the nominal operating point unit 415). Based on one or more inputs, the nominal operating point unit 415 outputs a target gas damper position to the gas damper control 420, a target air damper position to the air damper control 425, and/or a target fan speed to the blower control 430.

Figure 5:
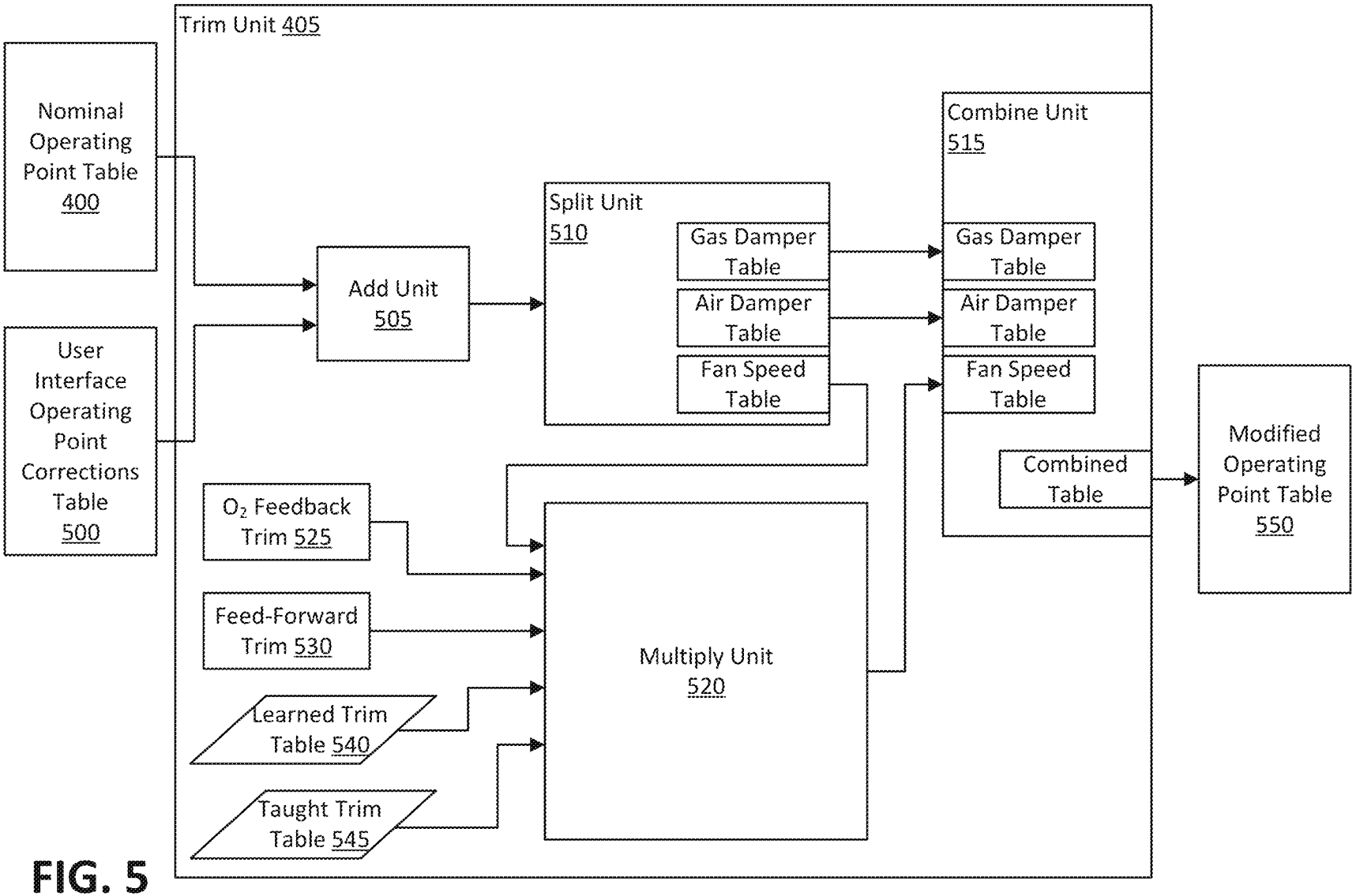
FIG. 5 is a block diagram of a trim unit of the combustion system of FIG. 1 according to some embodiments.

FIG. 5 is a block diagram of the trim unit 405 according to some embodiments. The trim unit 405 trims the combustion in the combustion system 100 by deviating airflow from the nominal operating condition in order to achieve the correct air-fuel ratio. The trim unit 405 implements trim values, which describe the magnitude and direction of change, to achieve the correct air-fuel ratio. In some embodiments, the trim value is a multiplier of nominal fan speed that is required. For example, a trim value of 1.00 means that no change is required. Alternatively, a trim value of 1.05 means a 5% increase in fan speed is needed or a trim value of 0.95 means a 5% decrease in fan speed is needed. The trim unit 405 may be operated during the ignition state and the run state of the fluid heating system. The trim value is applied to the combustion system 100 such that the fan speed is changed without a corresponding change in the gas damper angle, thus allowing the air-fuel ratio to be adjusted at a given firing rate.

The trim unit 405 may take a plurality of types of trim into consideration when determining the trim value. The first type of trim may derive from the user interface 202 and is output by a user interface operating point corrections table 500. The user interface operating point corrections table 500 may be similar to the nominal operating point table 400, however, it contains differential values rather than absolute values. Each of the values may be of the same resolution as the equivalent values in the nominal operating point table 400 but can be scaled a certain amount. For example, the fan speed in the user interface operating point corrections table 500 at point 1 may be scaled to be 100 RPM higher than the fan speed at point 1 in the nominal operating point table. The amount that the values can be scaled may be limited to prevent extreme adjustments. For example, fan speed can be scaled up to the maximum fan speed, while air damper position and gas damper position can both be scaled a maximum of 90°.

The second type of trim the trim unit 405 may consider is feed-forward trim 530. Feed-forward trim 530 applies automatic corrections to the air-fuel ratio based on barometric pressure (altitude) and pre-mix temperature. In some embodiments, a reference barometric pressure and a reference pre-mix temperature are determined during commissioning of the fluid heating system. For example, the reference barometric pressure may be set to a 1.0 trim value during commissioning. In some embodiments, multiple settings are established for feed-forward trim 530 depending on whether the air damper or the gas damper is adjusted. For example, a first setting may include barometric pressure feed-forward trim, a second setting may include feed-forward for fuel trim, and a third setting may include premix temperature feed-forward trim. Barometric pressure feed-forward trim and feed-forward for fuel trim are both based solely on barometric pressure readings. Premix temperature feed-forward trim is based solely on the premix temperature sensor. The temperatures and pressures are considered on an absolute basis. For example, temperature can be in absolute units such as Kelvin or Rankine.

Feed-forward trim 530 can be calculated by the trim unit 405. Barometric pressure feed-forward trim can be calculated by dividing the reference barometric pressure by the actual air pressure as seen in Equation 1 below:

$$\mathrm{Trim}_{baro-air} = \frac{P_{bar-ref}}{P_{bar}} \quad \text{[Equation 1]}$$

Feed-forward for fuel trim can be calculated by taking the reference pressure for the feed-forward fuel trim (which is a different reference value than the barometric pressure reference value) divided by the actual air pressure and multiplying that with the square-root of the actual air pressure divided by the reference pressure for the feed-forward fuel trim as seen in Equation 2 below:

$$\mathrm{Trim}_{ff-fuel} = \left(\frac{P_{bar-fuelref}}{P_{bar}}\right)\sqrt{\frac{P_{bar}}{P_{bar-fuelref}}} \quad \text{[Equation 2]}$$

Premix temperature feed-forward trim can be calculated by dividing the actual premix temperature by the reference premix temperature as seen in Equation 3 below:

$$\mathrm{Trim}_{premix} = \frac{T_{premix}}{T_{premix-ref}} \quad \text{[Equation 3]}$$

The third type of trim the trim unit 405 considers is $O_2$ feedback trim 525. $O_2$ feedback trim 525 is based on one or more $O_2$ sensor readings. $O_2$ feedback trim 525 may be a single trim value that is applied equally to all modulation points (i.e., universal trim). Upon power-up of the fluid heating system, the $O_2$ feedback trim 525 may be loaded with a trim value of 1.0. The $O_2$ feedback trim 525 may be saved to the memory of the feedback controller 220. $O_2$ feedback trim 525 will be discussed in detail below with respect to FIGS. 6 and 7.

The fourth type of trim the trim unit 405 considers is learned trim, presented in a learned trim table 540. The learned trim table 540 includes learned trim values that correspond to the ten modulation points in the nominal operating point table 400. A trim value may be applied to a current modulation percentage based on linear interpolation between points in the learned trim table 540. The points in the learned trim table 540 may be learned using an integrator that drives the feedback trim to zero. The learned trim table 540 may continuously updated during operation and saved to the memory of the feedback controller 220. Additionally, the learned trim table 540 may include upper and lower limits. The learned trim table 540 will be discussed in detail below with respect to FIGS. 8 and 9.

The fifth type of trim the trim unit 405 considers is taught trim, presented in a taught trim table 545. The taught trim table 545 is a table of trim values where the current trim value is based on linear interpolation. The taught trim table 545 may be set during commissioning of the fluid heating system and is saved in the memory of the feedback controller 220.

In the illustrated embodiment, the trim unit 405 includes an add unit 505, a split unit 510, a combine unit 515, a multiply unit 520, $O_2$ feedback trim 525, feed-forward trim 530, the learned trim table 540, and the taught trim table 545. The trim unit 405 receives inputs from the nominal operating point table 400 and/or the user interface operating point corrections table 500. The trim unit 405 then outputs a combined table to the modified operating point table 550.

The nominal operating point table 400 and the user interface operating point corrections table 500 are input into the add unit 505. The add unit 505 combines the nominal operating point table 400 and the user interface operating point corrections table 500 and feeds the result to the split unit 510. The split unit 510 splits the input into the three distinct combustion system 100 controls: a gas damper table, an air damper table, and a fan speed table. In some embodiments, the gas damper table and air damper table are then fed into the combine unit 515 such that they are not subject to the other trims considered by the trim unit 405. The fan speed table is input into the multiply unit 520 along with the $O_2$ feedback trim 525, the feed-forward trim 530, the learned trim table 540, and/or the taught trim table 545. The multiply unit 520 outputs a multiplied trim value to the combine unit 515. The combine unit 515 combines the gas damper table, the air damper table, and the trimmed fan speed table to produce the combined table. The combined table is then output to the modified operating point table 550.

It should be understood that, in some embodiments, the gas damper table or the air damper table or both can additionally or alternatively be input into a similar multiply unit, so that the trim functions are applied to one or both of those variables in addition to or in alternative to the fan speed table.

Figure 6:
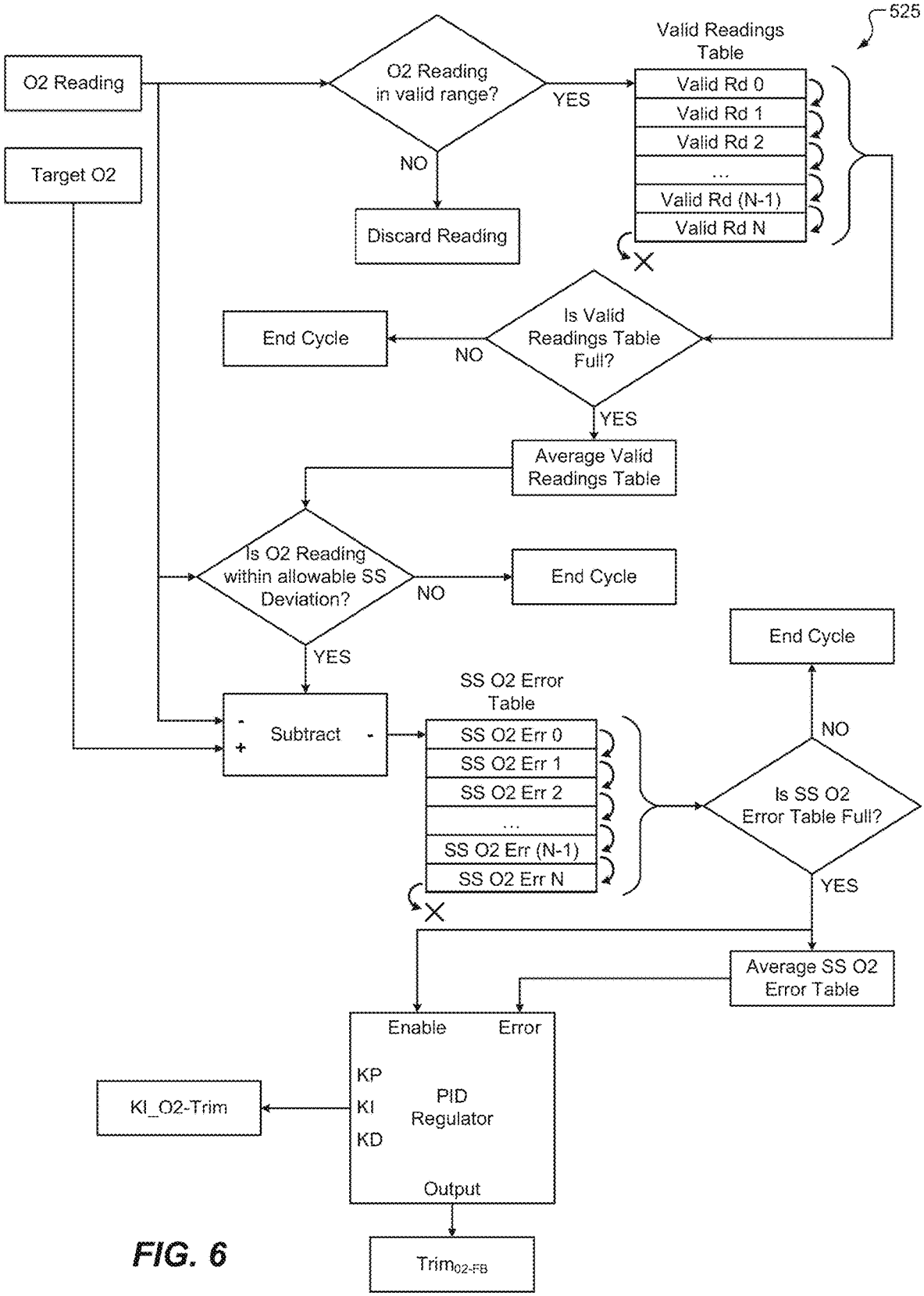
FIG. 6 is an $O_2$ feedback trim control of the combustion system of FIG. 1 according to some embodiments.

FIG. 6 illustrates the $O_2$ feedback trim 525 according to some embodiments. The $O_2$ feedback trim 525 is a first feedback control loop, while the learned trim table 540 is a second feedback control loop. The $O_2$ feedback trim 525 outputs a universal trim factor (i.e. regardless of firing rate/modulation percentage) to control combustion of the combustion system 100 to a desired $O_2$ target according to an $O_2$ target curve. The $O_2$ feedback trim 525 receives an $O_2$ reading from a wideband $O_2$ sensor, also referred to as an air-fuel ratio (AFR) sensor. The $O_2$ sensor operates accurately at stoichiometric combustion conditions ($\lambda=1$) and can also operate during leaner combustion ($\lambda>1$) which fluid heating systems typically operate in.

During operation of the fluid heating system, the combustion system 100 is run at a particular modulation percentage/firing rate. The $O_2$ sensor may sense that the $O_2$ is not at target and determine that an adjustment to the combustion system 100 may be necessary. The $O_2$ feedback trim 525 then attempts to drive the $O_2$ to target. Target $O_2$ values are held in the nominal operating point table 400 corresponding to each of the ten operating points. Additionally, the user interface operating point corrections table 500 includes ten target $O_2$ values for each operating point. The $O_2$ targets may be limited between an absolute maximum and an absolute minimum $O_2$ target.

The $O_2$ feedback trim 525 is an integral only feedback loop that ensures slow control action when the $O_2$ reading is near target in order to prevent continuous AFR oscillations. The $O_2$ feedback trim 525 can be paused externally at the user interface 202 or internally based on unsteady $O_2$ readings. The $O_2$ feedback trim 525 may operate using two separate buffers to ensure valid and steady $O_2$ readings for accumulating an $O_2$ feedback trim value. The first buffer is a "valid readings table" and the second buffer is a "steady-state (SS) $O_2$ error table." In some embodiments, each buffer holds a maximum of 100 positions and both buffers may be cleared upon an external pause of the $O_2$ feedback trim 525. In some embodiments, the buffers receive a new value and dump out the oldest value in the buffer. The $O_2$ feedback trim 525 includes a proportional-integral-derivative (PID) controller (or three-term controller) that determines the trim value to be output by the $O_2$ feedback trim 525.

Figure 7A:
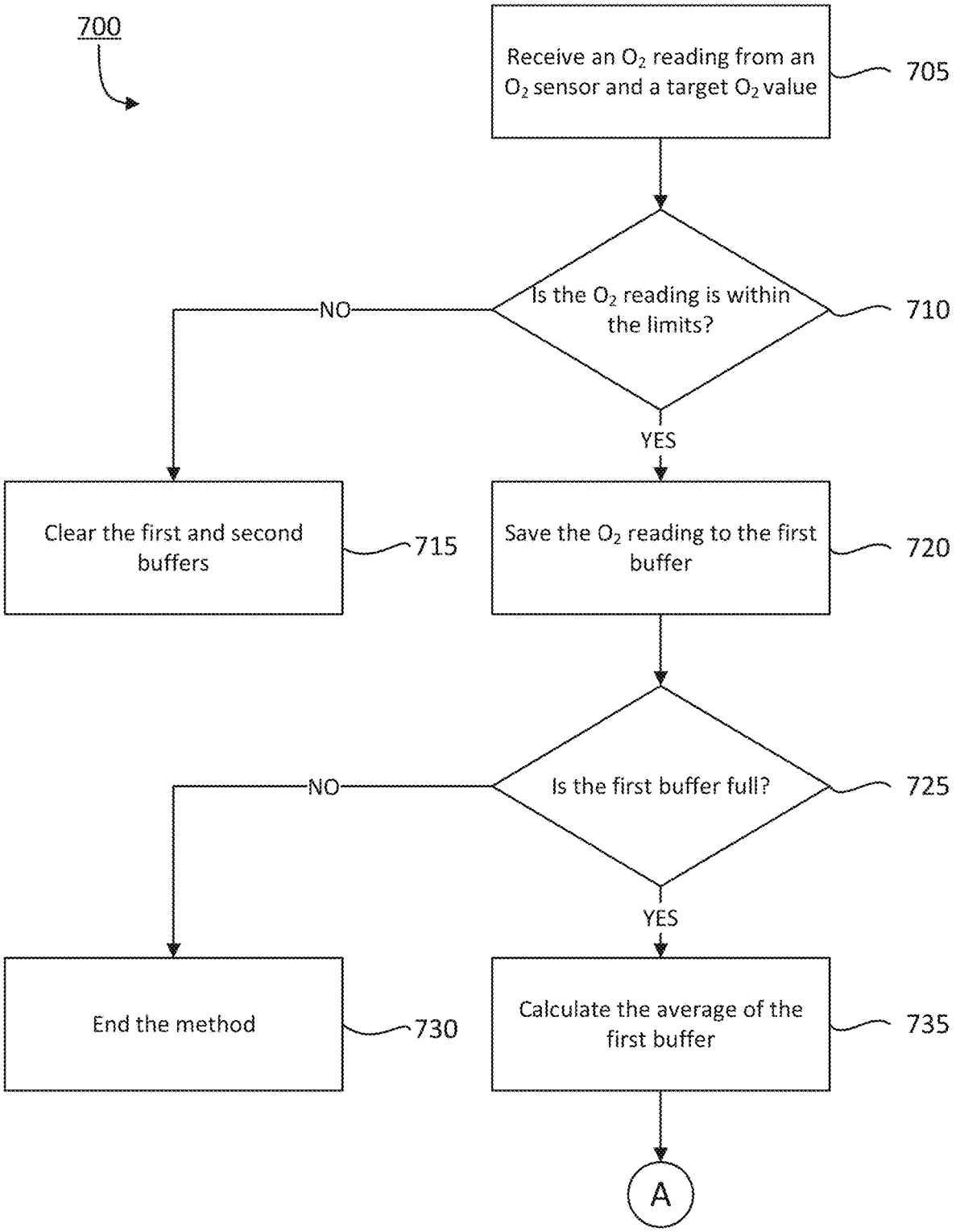
FIGS. 7A-7C are block diagrams of a method performed by the $O_2$ feedback control of FIG. 6 according to some embodiments.
Figure 7B:
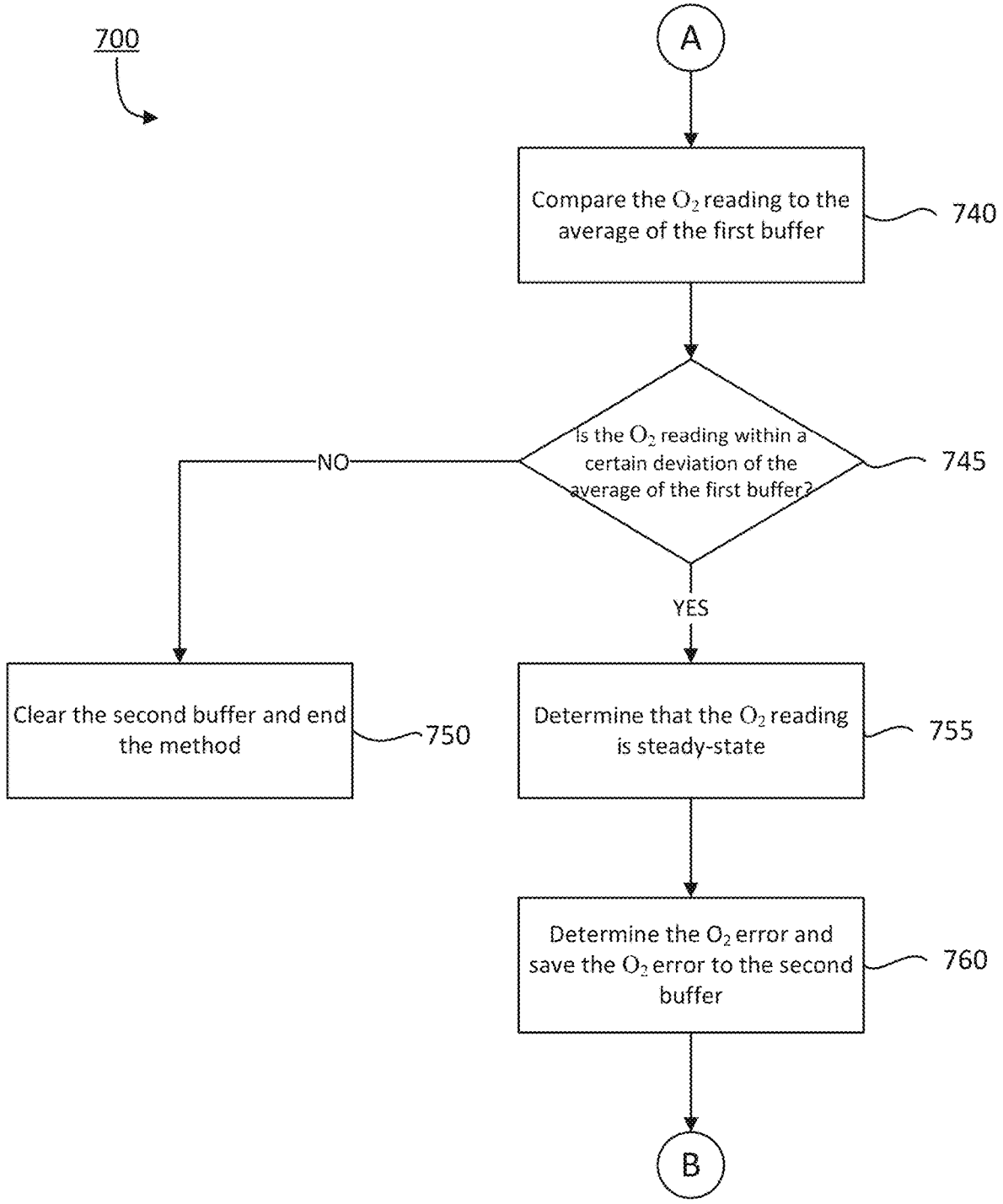
Figure 7C:
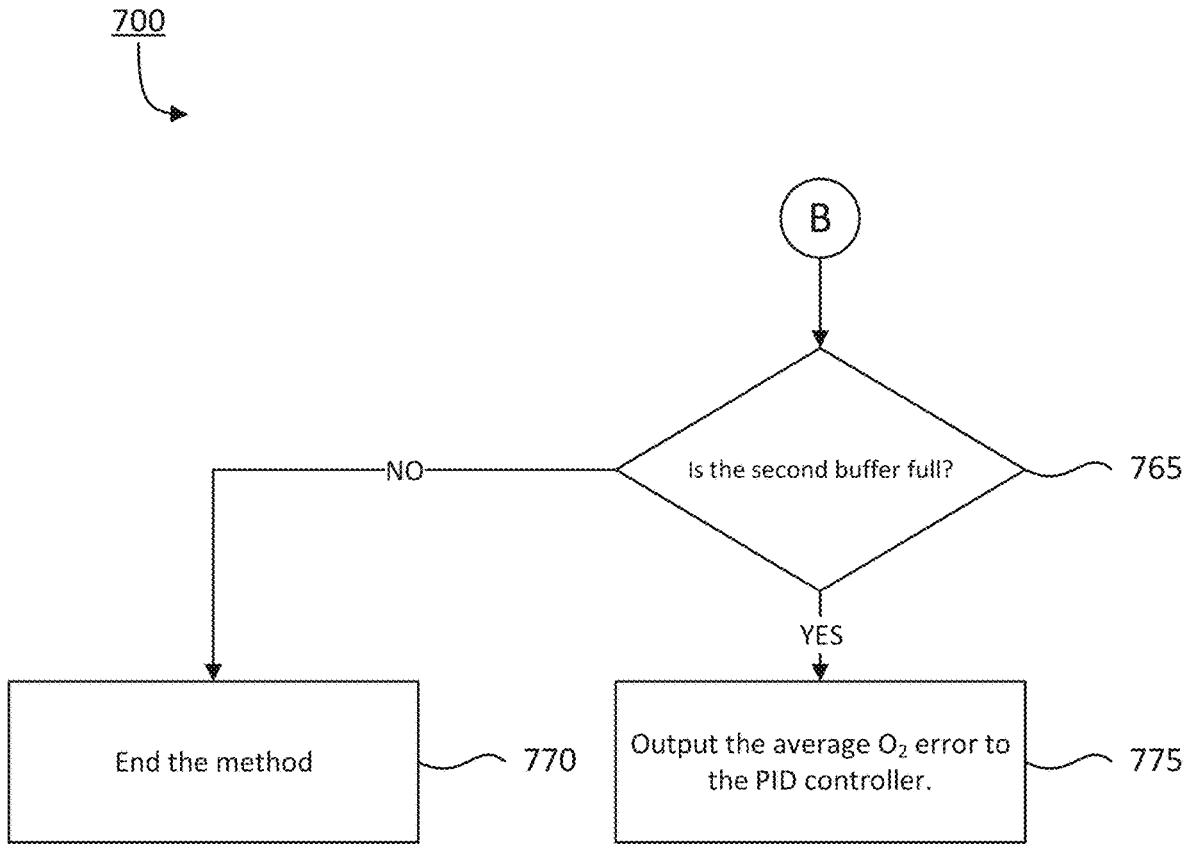

FIGS. 7A-7C are block diagrams illustrating a method 700 performed by the $O_2$ feedback trim 525 according to some embodiments. It should be understood that the order of the steps disclosed in the method 700 could vary. For example, additional steps may be added to the process and not all of the steps may be required, or steps shown in one order may occur in a second order. The method 700 begins at Block 705 when the $O_2$ feedback trim 525 receives an $O_2$ reading from the $O_2$ sensor and a target $O_2$ value from the additional of the nominal operating point table 400 and the user interface operating point corrections table 500. In some embodiments, the target $O_2$ value is related to the actual modulation percentage and not a commanded modulation percentage. At block 710, the $O_2$ feedback trim 525 compares the $O_2$ reading to high and low $O_2$ limits (typically within the range of −30.0%-30.0% $O_2$ concentration) to determine whether the $O_2$ reading is within the limits and therefore whether the $O_2$ reading is "valid." When the $O_2$ reading is not within the limits, then the first and second buffers will be cleared (block 715). If the $O_2$ reading is within those limits, then the $O_2$ reading is saved to the first buffer (block 720). At block 725, the $O_2$ feedback trim 525 determines whether the first buffer is full. If the first buffer is not full, then the $O_2$ feedback trim 525 iteration is completed (block 730). If the first buffer is full, then the method proceeds to block 735.

At block 735, the $O_2$ feedback trim 525 calculates the average of the first buffer. The method 700 proceeds to block 740. At block 740, the $O_2$ feedback trim 525 compares the $O_2$ reading to the average of the first buffer. At block 745, the $O_2$ feedback trim 525 determines whether the $O_2$ reading is within a certain deviation of the average of the first buffer and therefore whether the $O_2$ reading is "steady-state." If the $O_2$ reading is not considered within a certain deviation of the average of the first buffer and therefore not steady state, then the second buffer is cleared and the $O_2$ feedback trim 525 iteration is complete (block 750). If the $O_2$ reading is within a certain deviation of the average, then the $O_2$ reading is considered steady-state (block 755). In some embodiments, the $O_2$ reading may be ±0.5% different than the average and still be considered steady-state.

At block 760, an $O_2$ error is determined based on the difference between the target $O_2$ and the $O_2$ reading, and the $O_2$ error is saved to the second buffer. At block 765, the $O_2$ feedback trim 525 determines whether the second buffer is full. If the second buffer is not full, then the $O_2$ feedback trim 525 iteration is complete (block 770). If the second buffer is determined to be full, the, the method 700 proceeds to block 775. At block 775, the average $O_2$ error is output to the PID controller. The PID controller multiplies the average $O_2$ error by a coefficient (settable at the user interface 202) and adds that number to the current $O_2$ feedback trim value (which is 1.0 upon startup of the fluid heating system).

The PID controller may consider the size of the $O_2$ error. For example, when there is a relatively small $O_2$ error, the $O_2$ feedback trim value may not be impacted since the $O_2$ reading is approximately near to the target $O_2$. In order to determine whether the $O_2$ error is large enough to impact the $O_2$ feedback trim value, a parameter is set that indicates the smallest non-zero $O_2$ error that will be evaluated by the PID controller. For example, the parameter may be +0.1% $O_2$. Additionally, in some embodiments, the PID can accumulate the small $O_2$ error values and then output the $O_2$ feedback trim value after the accumulated $O_2$ error has reached a "carry value."

Figure 8:
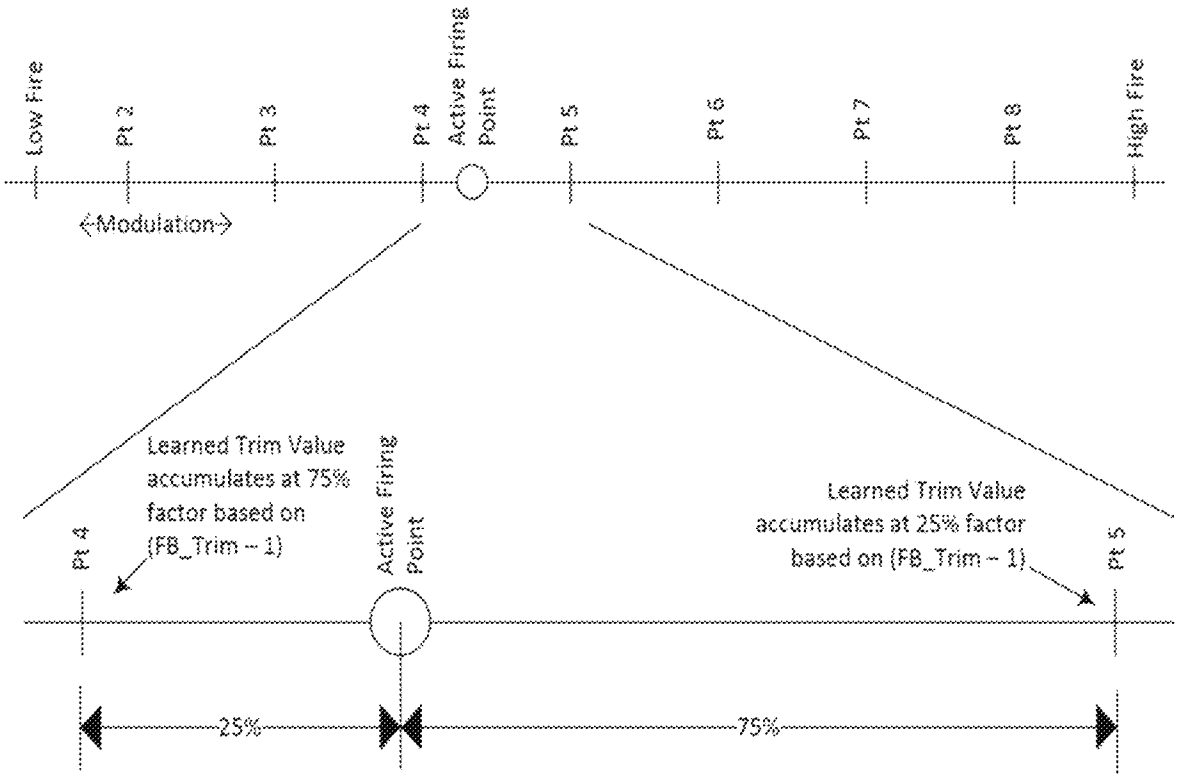
FIG. 8 is learned trim control of the combustion system of FIG. 1 according to some embodiments.

FIG. 8 illustrates a learned trim control 800 according to some embodiments. The learned trim control 800 is considered the second feedback loop. The learned trim control 800 adjusts combustion factors (air damper angle, gas damper angle, and/or blower speed) that are not universally related to modulation rate. When the $O_2$ feedback trim 525 drives the $O_2$ to a target value, the output of the $O_2$ feedback trim 525 is no longer at 100%. Therefore, a learned trim control 800 is needed to drive the output of the $O_2$ feedback trim 525 to 100%. The output of the learned trim control 800 is reverse interpolated into the learned trim table 540. The learned trim table 540 is then used to by the trim unit 405 to adjust the combustion system 100. In some embodiments, the learned trim table 540 is intended to be used as a back-up in the case that the $O_2$ sensor no longer works. The learned trim control 800 can be paused anytime the $O_2$ feedback trim 525 is paused, any time the $O_2$ error is too high, and/or any time the $O_2$ feedback trim value is saturated at a limit. The learned trim control 800 may be paused to mitigate the risk of a double trim over-run, where the trim limits of both the $O_2$ feedback trim 525 and the learned trim control 800 combine together to cause a too large trim. In some embodiments, the learned trim control 800 is initiated only once the $O_2$ feedback trim 525 has run for a predetermined amount of time.

The learned trim control 800 is a relatively slow, integral-only control function that controls combustion based on the $O_2$ feedback trim value compared to a target value of 1.0. In other words, the learned trim control 800 is intended to drive towards zero $O_2$ feedback trim 525 action. The learned trim control 800 moves the $O_2$ target out of range in an opposite direction due to the adjustment being doubly applied in the $O_2$ feedback trim 525 and the learned trim table 540. For example, the learned trim control 800 changes the trim value in the same direction as the $O_2$ feedback trim value deviates from 1.0. This causes a reduction in the output of the $O_2$ feedback trim 525 to bring the $O_2$ back to target. If the $O_2$ feedback trim 525 is not back to 100%, then some amount of trim will be determined by the learned trim control 800 and the accumulated by the learned trim table 540. Over time, the trim will be moved such that the $O_2$ feedback trim 525 is at 100%.

Figure 9:
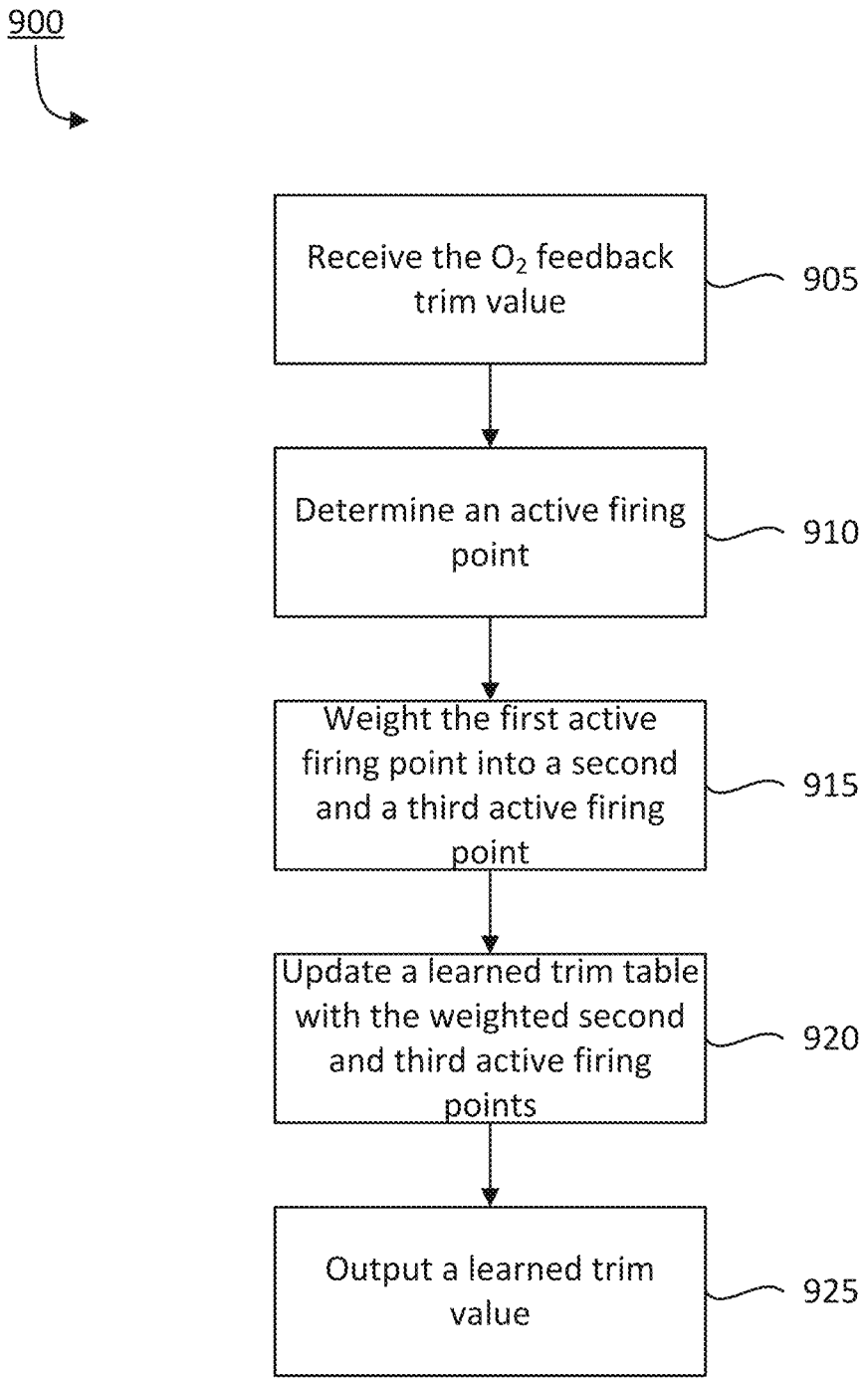
FIG. 9 is a block diagram of a method performed by the learned trim control of FIG. 8 according to some embodiments.

FIG. 9 is a block diagram of a method 900 performed by the learned trim control 800 according to some embodiments. It should be understood that the order of the steps disclosed in the method 900 could vary. For example, additional steps may be added to the process and not all of the steps may be required, or steps shown in one order may occur in a second order. At block 905, the learned trim control 800 receives the $O_2$ feedback trim value. At block 910, the learned trim control 800 determines an active firing point (for example, a modulation percentage demanded). As discussed above, the learned trim table 540 includes ten points (corresponding to modulation percentages/firing rates) with corresponding operating points (air damper angle, gas damper angle, and/or blower speed). As seen in FIG. 8, in some embodiments, the active firing point lies between two points in the learned trim table 540. At block 915, the active firing point that is determined based on the $O_2$ feedback trim value is weighted into the two points adjacent to the active firing point in the learned trim table 540. The magnitude of the $O_2$ feedback trim value added to each adjacent point is inversely related to how close the active firing point is to the adjacent point in the learned trim table 540. For example, if the active firing point was 25% of the way between Pt. 4 and Pt. 5 (as shown in FIG. 8), then 75% of the deviation of the $O_2$ feedback trim value from 1.0 would be added to Pt. 4 and the remaining 25% of the deviation would be added to Pt. 5 in the learned trim table 540 (Block 920). By way of further example, if the $O_2$ feedback trim value (FB_Trim) was a value of 1.04, then the learned trim value for Pt. 4 would increase by 0.03 and the learned trim value for Pt. 5 would increase by 0.01. At block 925, the learned trim control 800 outputs a value from the learned trim table 540 to the multiply unit 520 in the trim unit 405, as discussed above with respect to FIG. 5.

It may be desirable to implement limits on what values can be held in the learned trim table 540 to avoid having a trim value learned by the learned trim control 800 that is larger than limited by the speed limiting values to be held in the learned trim table 540. In the event that a learned trim value is saturated at an extreme allowable value, the learned trim control 800 will be allowed to continue, but values may not be interpolated into the learned trim table 540 to prevent learned trim values that are further outside the allowable range. In some embodiments, only one operating point may be modified by the learned trim control 800 if the other operating point is saturated.

Figure 10:
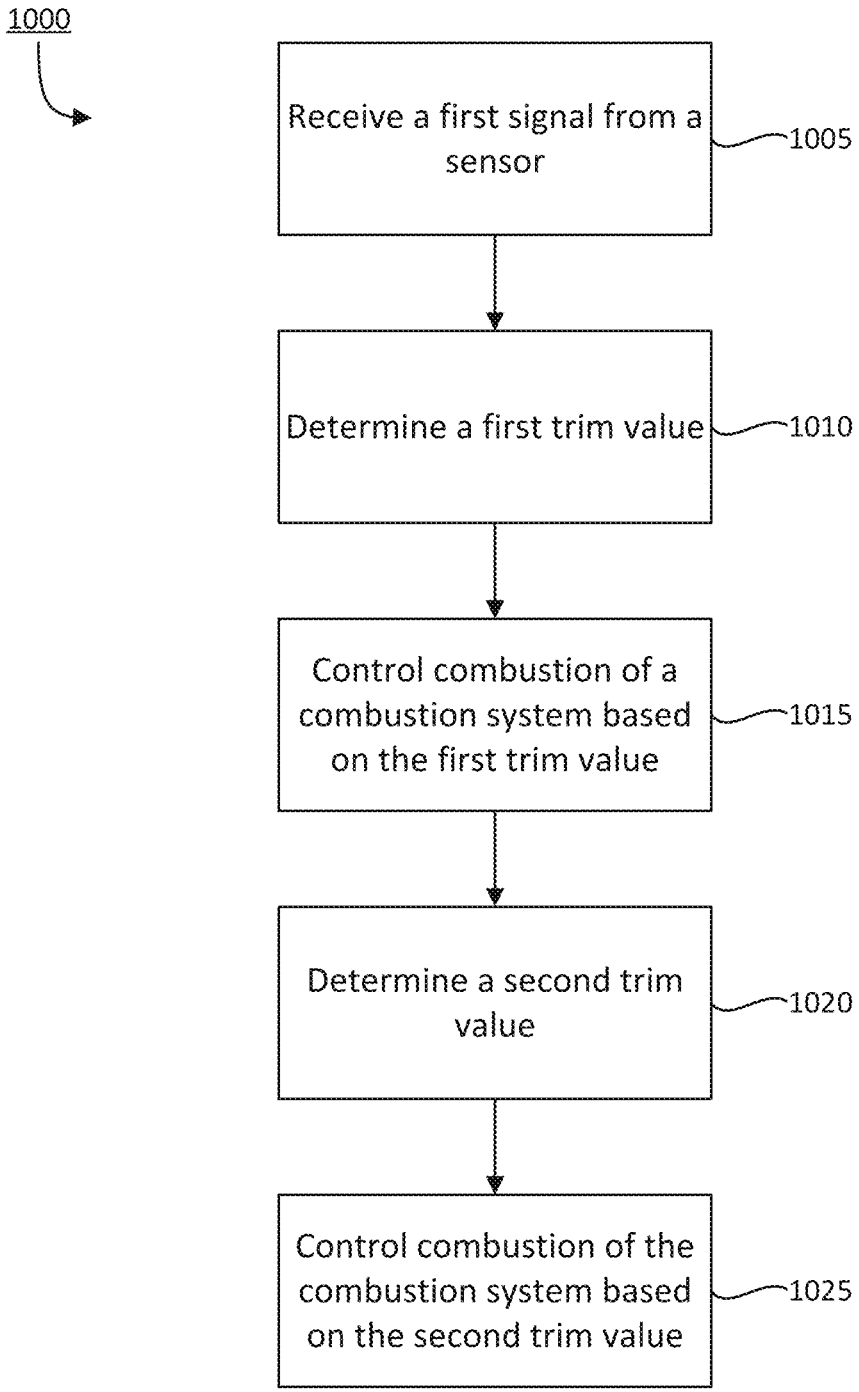
FIG. 10 is a block diagram of a method performed by the combustion control unit of FIG. 3 according to some embodiments.

FIG. 10 is a block diagram of a method 1000 performed by the combustion control unit 210 according to some embodiments. It should be understood that the order of the steps disclosed in the method 1000 could vary. For example, additional steps may be added to the process and not all of the steps may be required, or steps shown in one order may occur in a second order. At block 1005, a first signal is received from a sensor. In some embodiments, the first signal is an $O_2$ reading from an $O_2$ sensor. In some embodiments, the first signal is received by the $O_2$ feedback trim 525. At block 1010, a first trim value (for example, an $O_2$ feedback trim value) is determined. The $O_2$ feedback trim value may be determined according to the method 700, described above. At block 1015, the combustion control unit 210 controls combustion of the combustion system 100 based on the first trim value. At block 1020, a second value (for example, a learned trim value) is determined. The learned trim value is determined according to the method 900, described above. At block 1025, the combustion control unit 210 controls the combustion system 100 based on the second trim value.

In some embodiments, the learned trim control 800 may be operated with respect to combustion air temperature as opposed to modulation percentage/firing rate. In some embodiments, the learned trim control 800 may be operated with respect to combustion air temperature and modulation percentage/firing rate. For example, the output of the learned trim control 800 may be reverse interpolated into a learned trim table that is a two-dimensional array pertaining to combustion air temperature and modulation percentage/firing rate. Using this two-dimensional array may be useful because airflow can affect heat-up of combustion air in a building compared to a cold outdoor temperature where the combustion air is originally sourced. As firing rate increases, the combustion airflow increases, resulting in a lower "warm-up" effect in air inlet ducting. In some embodiments, there may be two learned trim controls whose outputs may be reverse interpolated into two separate learned trim tables, one for combustion air temperature and one for modulation percentage/firing rate. In some embodiments, the learned trim control 800 may be operated with respect to one or more of barometric pressure, humidity, fuel quality or composition, air quality or composition, flame quality, flue temperature, combustion temperature, water temperatures, condensate flow, condensate temperature.

In some embodiments, the $O_2$ feedback trim 525 and the learned trim control 800 may be operated based on NOx concentration, as opposed to $O_2$ concentration. In some embodiments, the $O_2$ feedback trim 525 and the learned trim control 800 may be operated based on NOx concentration in addition to $O_2$ concentration. For example, combustion control unit 210 may receive input from a NOx sensor as well as an $O_2$ sensor. An additional feedback loop is provided in this embodiment that adjusts the $O_2$ target in order to achieve a desired NOx. For example, the additional feedback loop may be an integral-only control that drives the output to an $O_2$ target that is different than the nominal combustion $O_2$ target in order to maintain NOx concentration at or below a threshold. This allows for the $O_2$ to be closest to the target $O_2$ while maintaining NOx at or below an acceptable threshold. The additional feedback loop applies a universal $O_2$ target change factor at all modulation percentages/firing rates. The additional feedback loop is the first feedback loop in the combustion control according to this embodiment. The output of the additional feedback loop may be combined with the output of a second feedback loop. In this embodiment, a NOx, $O_2$ target adjustment learned train table can be implemented where the second feedback loop drives the additional (first) feedback loop to some predefined value. For example, the setpoint of the second feedback loop may be greater than 100%. The outcome of the second feedback loop may be reverse interpolated to the NOx, $O_2$ target adjustment learned train table similar to the reverse interpolation described above.

In some embodiments, combustion air humidity may be considered instead of $O_2$ concentration. In some embodiments, $O_2$ target adjustment learned trim can be implemented as a combination of independent variables (such as humidity and modulation percentage) or as a combination multiple learned trim functions with single dimensional independent variables. For example, the $O_2$ target adjustment learned trim may be implemented with NOx in addition to other combustion control characteristics, such as burner temperature, flame length, flame characteristics (wavelength, light spectrum, color, flame size, flame flicker frequency, flame rectification/flame signal), combustion noise, and/or other factors.

With regard to flame rectification/flame signal, a burner control may confirm presence of flame before allowing the combustion to continue. In some cases, flame signals might get too low, putting reliable combustion at risk. Similar to the NOx approach, an $O_2$ target adjustment learned trim can be used to correct for low flame signals (by maintaining a flame signal at or above some threshold, and decreasing $O_2$ target to increase flame signal, or vice versa depending on the design of the flame). These systems would utilize the flame detection means already required in an appliance to maintain a sufficiently strong signal.

Combustion noise may also be taken into account for a combustion system. Various combustion noises can be produced combustion system that can typically be corrected by making corrections to the $O_2$ concentration. Microphones can be employed within the appliance to detect certain types of noises. Noises can be characterized by frequency, or sound spectrum makeup as well as by sound level or intensity. Some noises at certain frequencies might be resolved by increasing the air fuel ratio whereas some noises at other frequencies might be resolved by decreasing air fuel ratio. For each such type of noise, a first feedback loop and learned trim system can be applied in order to make adjustment to $O_2$ target.

Burner temperature is similarly affected by $O_2$ concentration, as well as by modulation percentage/firing rate (and other factors, potentially). Typically, raising the $O_2$ target can reduce burner temperatures. Similarly, higher burner temperatures are typically a bigger factor at lower modulation percentages/firing rates where there is less burner loading. Some burners in combustion systems (although not all) are particularly sensitive to burner deck temperature, especially with respect to the life of the burner. Such burner temperature control can be implemented by similar approach as is described for the NOx control, wherein an $O_2$ target adjustment system with first and second feedback loops can be implemented.

Combustion efficiency (related to $O_2$ sensor readings, water temperature, and/or modulation percentage), can be implemented with a combustion condensate flow sensor and temperature sensors as well as combustion air temperature and flue temperature.

In case of scenarios with $O_2$ target adjustment feedback and learning, as long as two or more $O_2$ target adjustments can be combined, these feedbacks can also be combined into a single control.

In some embodiments, the first feedback control and second feedback control may be operated based on fuel energy content. A Wobbe index sensor may be used on incoming fuel to estimate the fuel energy content. For example, two separate combustion sensors, such as two separate $O_2$ sensors, may be used to ascertain fuel quality/heat content. The first sensor being located such that no moisture has been removed from the gaseous combustion products, and the second sensor being fitted such that all or nearly all moisture is removed from the gaseous combustion products (this can be achieved through chemical desiccants in the flow path or by cooling to condense the moisture out, or by locating the sensor after the heat exchanger as long as the boiler is operating in a condensing mode). A factor can be determined based on the ratio of the wet $O_2$ concentration (from the first sensor) to that of the dry $O_2$ concentration (that of the second sensor). The ratio of wet to dry $O_2$ (or $CO_2$ or other components) can be used to infer the fuel energy content.

Alternatively, or additionally, an $O_2$ sensor shift test can be performed in conjunction with an $O_2$ or $CO_2$ sensor to ascertain fuel quality/heat content. In this test, while the appliance is operating at a known/nominal condition, an $O_2$ or $CO_2$ reading can be taken. Then, the combustion system can be modified to provide a predictable change in airflow at a constant fuel flow. This will result in a shift in the $O_2$ concentration, and thus provide a shift in the $O_2$ or $CO_2$ reading. The actual shift in the reading can then be compared to the theoretical shift for a given reference fuel to determine the energy content of the fuel compared to that of the reference fuel. Alternatively, the controls can back-calculate the stoichiometry to estimate the quality or type of the fuel.

Thus, embodiments described herein provide, among other things, combustion system control using multiple feedback control loops. Various features and advantages are set forth in the following claims.

What is claimed is:

1. A method for controlling a fluid heating system comprising:

receiving, at a first control loop, a sensor value indicative of a characteristic of the fluid heating system during a first operation;

determining, at the first control loop, a first trim value based on the sensor value;

determining, at a second control loop, a second trim value based on (i) a deviation of the first trim value from a reference value and (ii) an operational parameter of the fluid heating system; and controlling a second operation of the fluid heating system based on the second trim value.

2. The method of claim 1, wherein the first control loop determines the first trim value to drive the sensor value towards a reference sensor value.

3. The method of claim 2, wherein the second control loop determines the second trim value to drive the first trim value towards a reference trim value.

4. The method of claim 1, wherein the second control loop determines the second trim value by reverse-interpolating the operational parameter into a trim table.

5. The method of claim 4, wherein the trim table comprises one or more trim points and the operational parameter is used to interpolate between the one or more trim points.

6. The method of claim 1, wherein the second control loop comprises retrieving one or more trim points from a trim table.

7. The method of claim 6, wherein the second control loop comprises adjusting the one or more trim points based on the deviation.

8. The method of claim 7, wherein the second control loop comprises computing the second trim value based on the adjusted one or more trim points.

9. The method of claim 6, wherein the one or more trim points correspond to at least one of a modulation percentage, a firing rate, an air damper angle, and a blower speed.

10. The method of claim 1, wherein the first control loop comprises:

determining whether the sensor value is within a valid range;

in response to determining that the first sensor value is within the valid range, adding the sensor value to a first buffer.

11. The method of claim 1, wherein controlling the second operation of the fluid heating system based on the second trim value comprises adjusting a combustion property of the fluid heating system based on the second trim value.

12. The method of claim 11, wherein the combustion property is at least one of an air-to-fuel ratio, a nitrogen oxides concentration, a carbon monoxide concentration, a combustion oscillation, a combustion noise, and a flame characteristic.

13. The method of claim 1, wherein the sensor value is at least one of an oxygen concentration and a nitrogen oxides concentration.

14. The method of claim 1, wherein the operational parameter is at least one of a modulation percentage and a firing rate.

15. The method of claim 1, wherein the first trim value is at least one of (i) a ratio of a reference barometric pressure and an actual air pressure and (ii) a ratio of an actual premix temperature and a reference premix temperature.

16. A method for controlling a fluid heating system, comprising:

receiving, at a first control loop, a sensor value indicative of a characteristic of the fluid heating system during a first operation;

determining, at the first control loop, a first trim value based on the sensor value;

determining, at a second control loop, a second trim value based on the first trim value and an operational parameter of the fluid heating system; and controlling a second operation of the fluid heating system based on the second trim value;

wherein the first control loop comprises:

adding the first trim value to a first buffer, determining whether the sensor value is within a defined deviation of an average value of the first buffer, in response to determining that the sensor value is within the defined deviation of the average value of the first buffer, determine an error between the sensor value and a reference sensor value, and adding the error to a second buffer.

17. The method of claim 16, wherein the first trim value is determined based on an average value of the second buffer.

18. A fluid heating system comprising:

a controller configured to receive a sensor value from a sensor, the sensor value indicative of a characteristic of the fluid heating system during a first operation;

wherein the controller is configured to:

determine, at a first control loop, a first trim value based on the sensor value;

determine, at a second control loop, a second trim value based on (i) a deviation of the first trim value from a reference trim value and (ii) an operational parameter of the fluid heating system; and control a second operation of the fluid heating system based on the second trim value.

19. The fluid heating system of claim 18, wherein the controller is configured to determine the first trim value to drive the sensor value toward a reference sensor value.

20. The fluid heating system of claim 19, wherein the controller is configured to determine the second trim value to drive the first trim value toward the reference trim value.

21. The fluid heating system of claim 18, wherein the controller is configured to determine the second trim value by reverse-interpolating the operational parameter into a trim table.

22. The fluid heating system of claim 18, wherein the controller is configured to, at the second control loop, retrieve one or more trim points from a trim table and adjust the one or more trim points based on the deviation.

23. The fluid heating system of claim 22, wherein the one or more trim points correspond to at least one of a modulation percentage, a firing rate, an air damper angle, and a blower speed.

24. The fluid heating system of claim 18, wherein the controller is configured to control the second operation by adjusting a combustion property of the fluid heating system based on the second trim value, wherein the combustion property is at least one of an air-to-fuel ratio, a nitrogen oxides concentration, a carbon monoxide concentration, a combustion oscillation, a combustion noise, and a flame characteristic.

25. The fluid heating system of claim 18, wherein the sensor value is at least one of an oxygen concentration and a nitrogen oxides concentration.

26. The fluid heating system of claim 18, wherein the operational parameter is at least one of a modulation percentage and a firing rate.

27. The fluid heating system of claim 18, wherein the first trim value is at least one of (i) a ratio of a reference barometric pressure and an actual air pressure and (ii) a ratio of an actual premix temperature and a reference premix temperature.

* * * * *